United States Patent [19]

Allen, Sr.

[11] Patent Number: 4,805,814

[45] Date of Patent: Feb. 21, 1989

[54] CONTAINER FOR LIQUIDS HAVING A MOUNTING BOSS FOR STORAGE OF A REMOVABLE DISPENSER

[75] Inventor: William R. Allen, Sr., La Porte, Ind. 46350

[73] Assignee: National Products Division, Kingsbury, Ind.

[21] Appl. No.: 80,881

[22] Filed: Aug. 3, 1987

[51] Int. Cl.[4] ..... B05B 7/30

[52] U.S. Cl. ..... 222/538; 222/464; 222/630; 239/318; 239/390; 248/79

[58] Field of Search ..... 222/192, 464, 530, 538, 222/545, 630; 248/79; 239/310, 314, 318, 390, 391, 397

[56] References Cited

U.S. PATENT DOCUMENTS

| | | | |
|---|---|---|---|
| 1,329,184 | 1/1920 | Hyams | 222/538 |
| 1,426,846 | 8/1922 | Craig | 222/530 X |
| 2,544,539 | 3/1951 | Manders | 239/318 X |
| 2,965,310 | 12/1960 | Gettelman | 239/391 |
| 3,195,784 | 7/1965 | Aaland | 222/545 X |
| 3,608,829 | 9/1971 | Forsman | 239/318 |
| 4,579,260 | 4/1986 | Young et al. | 222/465.1 |
| 4,705,191 | 11/1987 | Itzel et al. | 222/383 X |

FOREIGN PATENT DOCUMENTS

| | | | |
|---|---|---|---|
| 2909449 | 9/1980 | Fed. Rep. of Germany | 222/215 |

*Primary Examiner*—Kevin P. Shaver

*Attorney, Agent, or Firm*—Woodard, Emhardt, Naughton, Moriarty & McNett

[57] ABSTRACT

A container for liquids comprises a bottle having a continuous peripheral wall, a spout and an auxiliary mounting portion. The spout is threaded, in the preferred embodiment, so that a threaded cap or dispensing apparatus may be removably engaged thereon. The auxiliary mounting portion includes a pad on the top wall of the bottle having a mounting boss projecting from the pad. The mounting boss is threaded or serrated so that either the threaded cap or the dispensing apparatus can be removably engaged on the mounting boss when the other of the cap or dispensing apparatus is mounted on the bottle spout. The dispensing apparatus can comprise a spray head having a siphon tube that is detachable from the spray head. The bottle can be provided with a generally vertical groove in the peripheral wall of the bottle. The groove is sized to accommodate the siphon tube when the spray head is mounted on the mounting boss of the auxiliary mounting portion. The groove includes crimped portions that act to restrain the tube within the groove.

12 Claims, 3 Drawing Sheets

CONTAINER FOR LIQUIDS HAVING A MOUNTING BOSS FOR STORAGE OF A REMOVABLE DISPENSER

BACKGROUND OF THE INVENTION

The present invention relates generally to the field of bottles and containers for liquids having a sealed closure and a dispenser apparatus, such as a hose-end sprayer device. More particularly, this invention concerns an improved bottle construction adapted to better facilitate packaging, storage and use thereof.

Many liquid products in the consumer market are provided in bottles or containers having a dispensing apparatus, such as a hose-end sprayer and siphon spraying device. The sprayer is typically mounted over a single opening on a neck portion of the bottle using a threaded hub or adaptor. A siphon tube extending from the sprayer mechanism into the interior of the bottle is generally detachably connected to the sprayer, such as by a press-fit. The hose-end sprayer, for example, also includes a hose adaptor to accept the nozzle of a garden hose.

In packaging, storage and shipment of the chemical products sold in these types of bottles, it is necessary to provide some means to seal the neck opening of the bottle to prevent leakage of what may be highly toxic or corrosive liquids contained within. In some designs, the dispensing apparatus itself includes a plug or other means at its nozzle outlet that prevents operation of the dispenser and thereby seals in the contents of the bottle. This plug or other blockage means must be broken off or otherwise removed when the dispensing apparatus is to be used. Unfortunately, once this is done, the great majority of these designs do not provide for adequate resealing of the bottle or disruption of the dispensing device for subsequent storage and reuse.

Many other bottle dispenser combinations, such as hose-end sprayers which require attachment of a separate water source, such as a garden hose, have difficulty ever being adequately sealed to prevent leakage during packaging, storage and shipment. In these designs, for example, a shrink-fit or other seal may be affixed to the bottle outlet. However, this provides little structural protection, is susceptible of puncture or tear, and once removed is of no further use in resealing the bottle. Alternatively, the bottle outlet may be sealed with a separate removable cap specifically designed to prevent leakage. This cap may be reusable or not, but in any case, some manner must be provided to keep the loose dispensing apparatus with the bottle during packaging, storage and shipment.

One possible solution used by one manufacturer has been to put the dispensing apparatus in a bag which is attached to the bottle or to the display card on which the bottle is mounted. This design is cumbersome and inefficient, particularly from a product storage and marketing standpoint. Moreover, once the consumer initially opens the bottle by removing the cap, the cap is frequently discarded or lost which leaves only the dispensing apparatus to inadequately seal the bottle for subsequent storage and reuse.

For these and other reasons, an improved bottle construction has long been needed in this industry which will satisfy the above deficiencies and provide safe and effective means for packaging, storing, shipping and dispensing hazardous chemicals.

SUMMARY OF THE INVENTION

The present invention meets these needs, in providing a container for liquids for use with a threaded closure and dispensing apparatus comprises a bottle having a continuous peripheral wall and a spout. The spout has means for removably engaging the closure or the dispensing apparatus, such as by external threads. The bottle further comprises a mounting boss integral therewith, also having means for removably engaging the closure or the dispensing apparatus.

Another embodiment of the present invention is a container for use with a dispensing apparatus having a siphon tube detachable from a spray head, comprising a bottle having a continuous peripheral wall and a spout. The spout includes means for removably engaging the spray head thereon. The peripheral wall has a groove therein sized to receive the detachable siphon tube when the dispensing apparatus is not mounted on the bottle spout.

It is an object of the present invention to facilitate the storage and marketing of containers for liquids that use a separate sealing closure and dispensing apparatus. It is a further object to provide means for mounting both the sealing closure and the dispensing apparatus on the container so that either can be kept handy for use on the container. It is another object to provide a container for liquids that can be easily and cheaply manufactured. Further objects of the present invention will become apparent from the following disclosure and accompanying drawings.

DESCRIPTION OF THE PREFERRED EMBODIMENT

Figure 1:
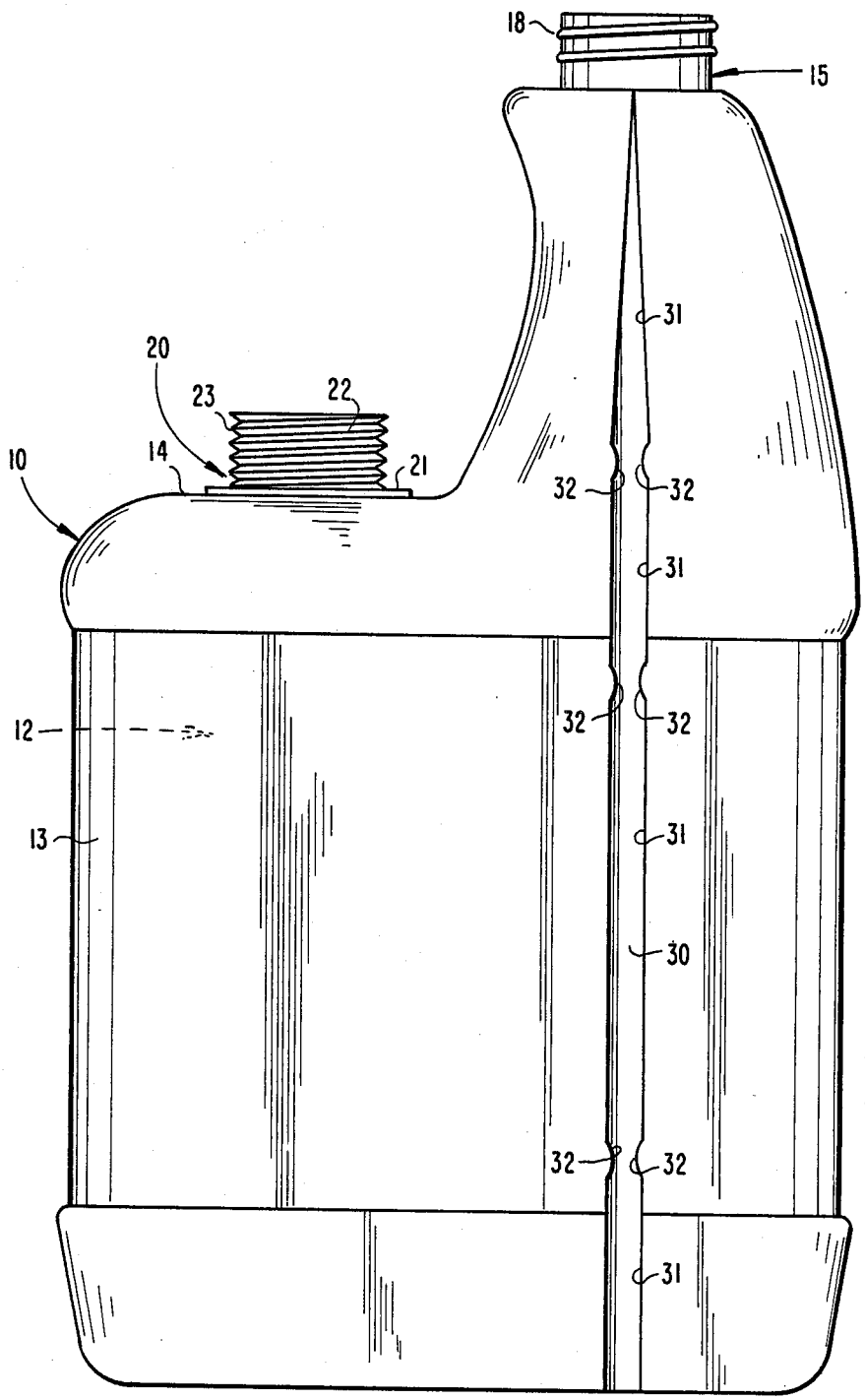
FIG. 1 is a side elevational view of a bottle of the preferred embodiment of the present invention.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the preferred embodiment depicted in FIG. 1, bottle 10 includes a continuous peripheral wall 13 forming an interior volume or cavity 12 to serve as a container for liquids. A spout 15 is formed at one end of bottle 10, communicating with interior cavity 12. Spout 15 has external threads 18 for removably engaging or receiving a threaded closure, such as 55, or a dispensing apparatus, such as 65. Threads 18 can be replaced with other means for removably engaging a closure or dispensing apparatus on spout 15, such as by snap-fit or press-fit.

Figure 2:
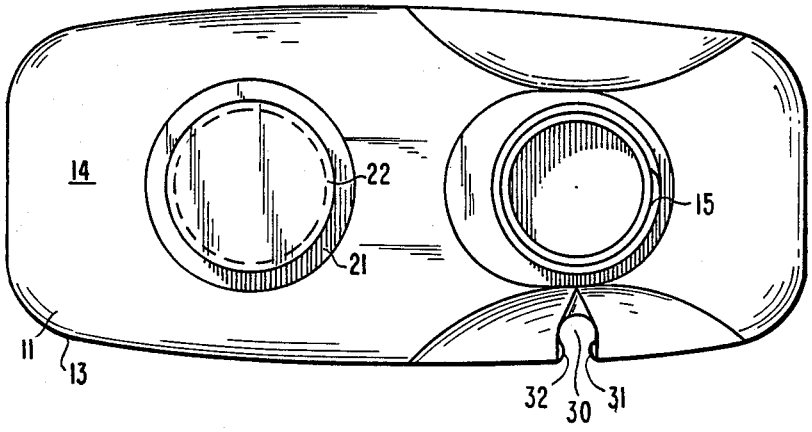
FIG. 2 is a top view of the bottle of the preferred embodiment.

Bottle 10 also includes an auxiliary mounting portion 20 integral with top wall 14. Mounting portion 20 includes a pad 21 with a mounting boss 22 extending therefrom. Mounting boss 22 includes means for engaging or receiving a threaded closure or dispensing apparatus, such as external threads 23, shown in FIG. 1. In the present embodiment, external threads 23 are configured to engage the threaded female nozzle of a typical garden hose. However, in other versions, threads 23 can be structurally similar to threads 18, or other substitute engagement means can be used. Mounting boss 22 can be solid, or it may have a hollow interior, as shown in FIG. 2, provided no opening is created in mounting boss 22 through which liquid may exit from interior cavity 12 of bottle 10. In this respect, mounting portion 20 is an auxiliary mounting portion in that it has the external appearance of a bottle spout, but liquid within bottle 10 is not allowed to pass therethrough.

Figure 3:
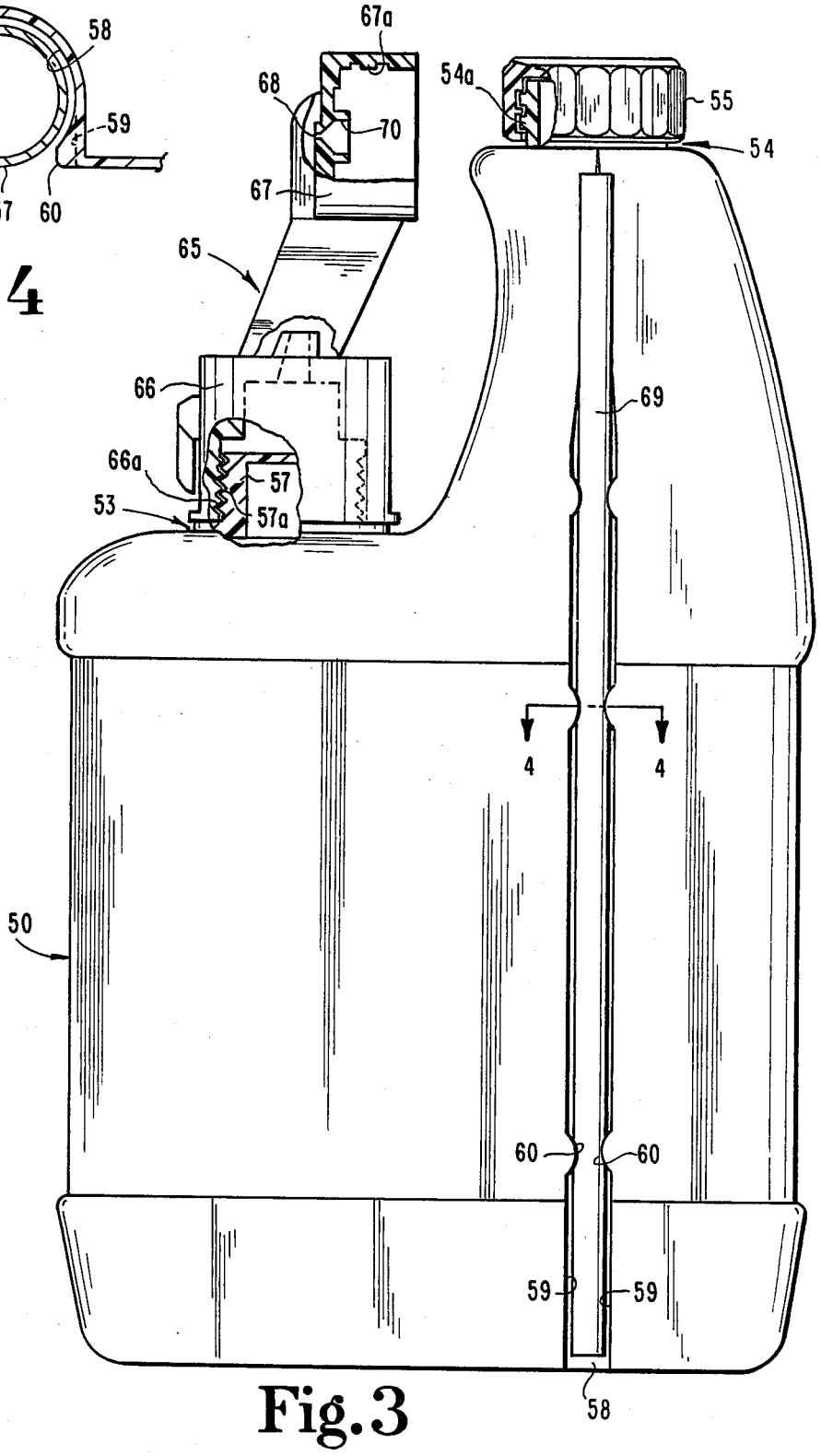
FIG. 3 is a partial cutaway side elevational view of the bottle of the preferred embodiment, as in FIG. 1, shown with a sealing closure, hose-end sprayer and siphon tube mounted thereon.

The use of auxiliary mounting portion 20 is best illustrated with reference to FIG. 3. In FIG. 3, bottle 50 is provided with a spout 54 and is similar, in all material respects, to bottle 10 and spout 15 of FIG. 1. Bottle 50 is further provided with an auxiliary mounting portion 53 having a mounting boss 57, which are, likewise, similar in all respects to auxiliary mounting portion 20 and mounting boss 22 of FIG. 1. Sealed cap 55 is threaded onto the external threads **54*a* of the spout 54. Sealed cap 55 is typical of such caps used in the art to provide a positive seal against leakage during shipment or storage of the product contained in bottle 50**.

In the one use of bottle 50, the dispensing means is a typical hose-end sprayer 65, such as that manufactured by Green Garden Co., of Somerset, Pa., designated as their model number DH-2. Sprayer 65 has a threaded hose adaptor portion 66 for mating with a water source, such as a garden hose, a threaded bottle adaptor portion 67 for mounting on spout 54 when the sprayer is in use, and venturi outlet orifice 68 through which the liquid contents of bottle 50 is dispensed. Bottle adaptor portion 67 has internal threads **67*a* for engagement with external threads 54*a* of spout 54. Hose adaptor portion 66 has internal threads 66*a* for engagement with external threads 57*a* of mounting boss 57. Threads 57*a* of mounting boss 57 can be identical to threads 54*a* of spout 54, so that sealed cap 55 and bottle adaptor portion 67 of hose-end sprayer 65 can be interchangeably engaged on mounting boss 57 when the other is mounted on spout 54. Further, mounting boss 57 can be provided with serrations, rather than threads, so that hose-end sprayer 65** can be press-fit over the serrations to removably engage the sprayer to the bottle.

It is seen in FIG. 3 that this use of auxiliary mounting portion 20 is a convenient method for storing a dispensing apparatus, such as hose-end sprayer 65, with the sealed product bottle. A liquid product sold in a bottle, such as 50, can be sold as shown in FIG. 3, or it can be shrink wrapped onto a display card. When the consumer wishes to use the liquid product contained within the bottle, it is only necessary to remove sealed cap 55 from spout 54, remove hose-end sprayer 65 from mounting boss 57, and replace the cap bottle adaptor portion 67 of the hose-end sprayer. If mounting boss 57 is appropriately threaded, sealed cap 55 can then be mounted onto the mounting boss in the same manner that the hose-end sprayer had previously been mounted. It is seen that another benefit of the present invention is that a sealed cap can be retained with the product bottle while the dispensing apparatus is being used. Thus, if it is later desired to seal the product bottle again, such as for storage or shipment, it is only necessary to exchange sealed cap 55 with dispensing apparatus 65 on the respective spout and auxiliary mounting portion.

In a second embodiment of the present invention, illustrated again with reference to FIG. 1, bottle 10 is provided with a groove 30. In this preferred embodiment, groove 30 is formed in peripheral wall 13 and extends generally vertically from the top to the bottom of bottle 10, tapering toward spout 15 at the top of bottle 10. This taper is due to the inward angle of the upper portion of bottle 10, as illustrated more clearly with reference to the top view of FIG. 2, and can be eliminated if the upper portion of the bottle is more vertically oriented. Groove 30 includes parallel edges 31 interspersed between crimped portions 32. As shown in FIG. 2 groove 30 is generally open between parallel edges 31, but is slightly closed between opposite crimped portions 32.

Figure 4:
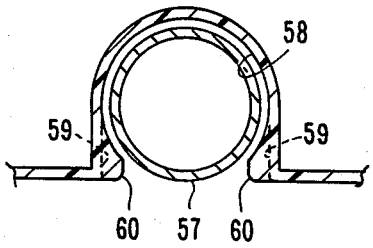
FIG. 4 is an enlarged cross sectional view taken at line 4—4 in FIG. 3 and viewed in the direction of the arrows.

The use of groove 30 is illustrated with reference to FIGS. 3 and 4. In FIG. 3, bottle 50 is provided with groove 58 having parallel edges 59 and crimped portions 60, each feature being identical to items 30, 31 and 32, respectively, shown in FIG. 1. Siphon tube 69 is provided as part of dispensing apparatus 65, which is, in the illustrated case, a hose-end sprayer. In hose-end sprayer 65, siphon tube 69 is press-fit into a tube adaptor portion 70 of the hose-end sprayer, as is common in the art. When bottle adaptor portion 67 of hose-end sprayer 65 is mounted over spout 54, siphon tube 69 extends into the interior cavity of bottle 50. Venturi outlet orifice 68 communicates with tube adaptor portion 70 and provides a spray outlet for liquid drawn from bottle 50. When hose adaptor portion 66 of hose-end sprayer 65 is connected to a garden hose, the venturi effect of water from the hose flowing along venturi outlet channel 68 over the end of siphon tube 69 will draw fluid from the interior cavity of bottle 50 for dispensing.

However, when dispensing apparatus 65 is not in use, and is in its stored position as shown in FIG. 3, there must be some provision for storage of siphon tube 69. Thus, tube 69 is inserted into groove 58 of bottle 50. Groove 58 has an effective diameter sized to encompass tube 69 fully within the groove, as shown in FIG. 4. Parallel edges 59 are sufficiently spaced apart to allow siphon tube 69 to pass between the edges into groove 58. Crimped portions 60 reduce the opening to groove 58 so that the opening is smaller than the diameter of tube 69. Thus, once tube 69 is within groove 58, it is restrained by crimped portions 60. Siphon tube 59 can either be pressed into groove 58 by compressing the tube or by expanding the crimped portions 60, or it can be guided into groove 58 from the top of bottle 50 as allowed by the angled upper portion of the bottle.

Bottles 10 and 50 of the preferred embodiments are formed of plastic in a typical blow-molding process. In the preferred embodiments to date, high density polyethylene has been used in a conventional commercial blow-molding process; however, a variety of plastics may be used with appropriate modifications in the blow-molding procedure. Furthermore, other materials may be suitable for construction of the bottle, such as glass or metal formed in processes adapted to these materials. In applicant's preferred embodiment, bottles 10 or 50 are blow-molded because the bottle design lends itself to easy and inexpensive fabrication by such a process. Mounting boss 22 of auxiliary mounting portion 20 is also formed in the blow-molding process, although other methods of fabrication are contemplated by this invention, such as separately attaching the boss to a pre-formed bottle. If the dispensing apparatus to be used with bottles 10 or 50 does not require the use of a siphon tube, such as siphon tube 69, grooves 30 or 58 can be eliminated from the bottle exterior.

It is apparent from the foregoing that the bottle construction of the present invention represents an improvement over prior art bottles, particularly plastic bottles using a hose-end sprayer or siphon-type dispensing apparatus. The present invention provides means for storing either the dispensing apparatus or sealed cap when not in use, such as during shipment, storage, or display. The present invention is particularly suited for dispensing apparatus that require the use of a siphon tube. This invention eliminates the problem inherent with other bottle configurations of accounting for the dispensing apparatus displayed and sold with a sealed liquid container. The present invention also provides a bottle design that is simple and economical to fabricate, since it can be blow-molded.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A container for liquids having a separate removable closure and a separate removable dispensing apparatus, wherein the dispensing apparatus is a hose-end sprayer having a threaded hose adaptor portion and a threaded bottle adaptor portion, comprising:

a bottle defining an interior cavity for holding a liquid product;

a spout on said bottle opening into said cavity and having first means for removably engaging said closure thereon and for removably engaging said dispensing apparatus thereon, said first means having first external threads on said spout;

a sealed mounting boss on said bottle having second means for removably engaging the dispensing apparatus thereon when the closure is engaged on said spout, said second means having second external threads on said mounting boss; and further wherein;

said first external threads are configured so that each of said closure and the threaded bottle adaptor portion can be interchangeably engaged thereon; and said second external threads are configured so that the hose adaptor portion can be removably engaged thereon.

2. The container for liquids of claim 1, wherein said mounting boss has a hollow interior opening into said interior cavity.

3. The container for liquids of claim 1, wherein the dispensing apparatus further has a detachable siphon tube, and further wherein:

said siphon tube is adapted to engage the dispensing apparatus adjacent the threaded bottle adaptor portion with the siphon tube extending through said spout into said interior cavity when the threaded bottle adaptor portion is mounted on the spout; and said bottle further includes an outer surface having a groove formed therein, said groove being sized to receive the siphon tube therein when the tube is detached from the dispensing apparatus.

4. The container for liquids of claim 3, wherein:

said groove includes opposite edges with at least one portion thereof being crimped so that the siphon tube is restrained within said groove.

5. The container for liquids of claim 4, wherein said bottle is formed by blow-molding.

6. The container for liquids of claim 4, wherein:

said groove is recessed from said outer surface so that the tube does not project beyond said outer surface when the tube is disposed within said groove.

7. A dispenser for liquids comprising:

a bottle defining an interior cavity for holding a liquid product;

a spout on said bottle opening into said cavity;

closure means for removably sealing said spout;

dispensing means, separate from said closure means, for removably engaging said spout and dispensing liquid product from said interior cavity when engaged on said spout;

a sealed mounting boss on said bottle having mounting means for removably engaging said dispensing means when said dispensing means is not engaged on said spout; and wherein;

said closure means includes a threaded cap and said spout includes first external mating threads for engaging said threaded cap;

said dispensing means comprises a hose adaptor portion threaded for engaging a male hose fitting thereon, and a bottle adaptor portion threaded for engaging said first external mating threads of said spout; and said mounting means includes second external mating threads on said mounting boss for engaging said threaded hose adaptor portion.

8. The container for liquids of claim 7, wherein said mounting boss has a hollow interior opening into said interior cavity.

9. The dispenser for liquids of claim 7, wherein:

said dispensing means further comprises a siphon tube detachably connected to said dispensing means such that when said bottle adaptor portion is engaged on said spout, said siphon tube extends through said spout into said interior cavity; and said bottle further includes an outer surfaces having a groove formed therein, said groove sized to receive said siphon tube therein when said tube is detached from said dispensing means.

10. The dispensing for liquids of claim 9, wherein:

said groove includes opposite edges with at least one portion thereof being crimped so that said siphon tube is restrained within said groove.

11. The container for liquids of claim 10, wherein said bottle is formed by blow-molding.

12. The container for liquids of claim 11, wherein:

said groove is recessed from said outer surface so that said siphon tube does not project beyond said outer surface when said tube is disposed within said groove.

* * * * *